US007051723B2

(12) United States Patent
Kiker

(10) Patent No.: US 7,051,723 B2
(45) **Date of Patent: *May 30, 2006**

(54) IGNITION SPARK ENHANCING DEVICE

(76) Inventor: Harvey George Kiker, 3601 E. Ramsey Way, Avon Park, FL (US) 33825

( * ) Notice: Subject to any disclaimer, the term of this patent is extended or adjusted under 35 U.S.C. 154(b) by 166 days.

This patent is subject to a terminal disclaimer.

(21) Appl. No.: 10/832,021

(22) Filed: Apr. 26, 2004

(65) Prior Publication Data

US 2004/0194768 A1 Oct. 7, 2004

Related U.S. Application Data

(63) Continuation-in-part of application No. 10/393,693, filed on Mar. 20, 2003, now Pat. No. 6,796,298, which is a continuation-in-part of application No. 10/353,329, filed on Jan. 29, 2003, now Pat. No. 6,736,119.

(51) Int. Cl.
*F02P 3/02* (2006.01)

(52) U.S. Cl. ..... 123/620; 13/536; 13/647

(58) Field of Classification Search ..... 123/620, 123/143 C, 536, 647, 633, 169 PH, 169 PA; 439/125, 126, 127, 502
See application file for complete search history.

(56) References Cited

U.S. PATENT DOCUMENTS 3,939,814 A 2/1976 Bergstresser
4,193,651 A 3/1980 Hays
4,269,160 A 5/1981 Irvin
4,494,520 A 1/1985 Huritz
4,502,025 A 2/1985 Carl
4,596,222 A 6/1986 Ortiz
4,665,922 A 5/1987 Gillbrand et al.
4,774,914 A 10/1988 Ward
4,784,100 A 11/1988 Huan
4,944,280 A 7/1990 Washington
5,109,828 A 5/1992 Tagami et al.
5,134,985 A 8/1992 Rao
6,089,214 A 7/2000 Anderson
6,328,010 B1 12/2001 Thurman
6,358,072 B1 3/2002 Johnson
6,374,816 B1 4/2002 Funk et al.

*Primary Examiner*—Tony M. Argenbright
*Assistant Examiner*—Arnold Castro
(74) *Attorney, Agent, or Firm*—Charles J. Prescott

(57) ABSTRACT

An ignition spark enhancing device and spark plug wire disposed in or establishing the electrical path between a spark source and a spark plug of an internal combustion engine. The device includes one or more coils of conductive hollow tubing formed from a length of conductive tubing configured for connection to the spark plug wire of the device or to a spark plug. The tubing is preferably copper and may also be aluminum or other conductive material and is also preferably used to form each spark plug wire as well for durability. At least five complete loops or turns wound concentrically or in helix fashion are preferred. The device is also preferably coated with a non-conductive material to reduce any risk of electrical shock or short circuit.

8 Claims, 5 Drawing Sheets

IGNITION SPARK ENHANCING DEVICE

CROSS-REFERENCE TO RELATED APPLICATIONS

This is a continuation-in-part of application Ser. No. 10/393,693 filed Mar. 20, 2003 now U.S. Pat. No. 6,796,298 which is a continuation-in-part of application Ser. No. 10/353,329 filed Jan. 29, 2003 now U.S. Pat. No. 6,736,119.

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to devices for increasing internal combustion engine efficiency, economy and performance, and more particularly to a coil wound conductive device formed of highly conductive tubing positioned in the pathway between the spark source and each spark plug of such engines.

2. Description of Related Art

In an internal combustion engine using a spark plug to ignite combustion, the intensity or voltage of the spark produced across the gap of the spark plug has a great deal to do with the efficiency, economy, power output and acceleration to full power of the internal combustion engine. A great deal of technology has therefore developed to enhance this functional aspect of the operation of the engine.

A number of prior art devices are known which have attempted to provide a "hotter" spark to the spark plugs to achieve the enhanced performance of the engine. One such prior patented device is disclosed in U.S. Pat. No. 4,944,280 invented by Washington which teaches a separated circuit or spark gap producing device that introduces an auxiliary gap into the electrical path between the spark source and the spark plug. This area of technology directed to producing a capacitive-type spark gap for enhanced voltage buildup before current is discharged and reaches the spark plug is well known. However, Washington developed an improved apparatus which accurately controls and varies this spark gap to achieve individual and selective adjustment of the size of the gap to achieve even more optimal performance from the engine.

Tagami in U.S. Pat. No. 5,109,828 teaches an apparatus for supplying high voltage to the spark plug via a spark coil and a distributor plate of unitary construction.

In U.S. Pat. No. 6,328,010, Thurman teaches a spark plug wire harness assembly having a substantially rigid body, plug wire mounting posts, and output terminals. The conductors are embedded within the rigid body.

An electrically controlled engine ignition system for increased power and economy was invented by Huan and disclosed in U.S. Pat. No. 4,784,100. This disclosure is of an ignition system which is capable of controllably adjusting the ignition spark and timing in accordance with conditions imposed on the automobile by road and driver habit.

The present invention discloses a very simple, economical to manufacture and easy to install or incorporate into an originally manufactured spark plug wire extending from a spark source to the spark plug. The device, which in one embodiment is added to the spark plug wire itself in series therealong or, in another embodiment, at the end of the spark plug wire immediately adjacent to the spark plug, is formed of a length of highly conductive tubing, preferably copper tubing, having one or more loops of the coiled tubing formed therein. In still another embodiment, the entire spark plug wire is replaced with a single length of conductive tubing with a coiled segment formed therealong. This improvement has been shown to result in increased power, acceleration and economy. The preferred embodiment of the invention replaces the conventional spark plug wire in its entirety and replaces it preferably with a continuous length of copper tubing sized in inside and outside diameter to be substantially similar to that of the spark enhancing device itself. Alternately, the length of spark plug wire may be replaced by heavier current and voltage carrying spark plug wire formed of strands of solid copper wire encased within a shielding jacket or casing therefor.

BRIEF SUMMARY OF THE INVENTION

This invention is directed to an ignition spark enhancing device which establishes the electrical path between a spark source and a spark plug of an internal combustion engine. The device includes one or more coils or turns of conductive hollow tubing having ends configured for connection to a new replacement spark plug wire and to a spark plug, respectively. Alternately, the entire spark wire is replaced. The tubing is preferably copper and may also be aluminum or other conductive material. At least five complete loops or turns wound concentrically or in helix form are preferred. The device and its new spark plug wire are also preferably coated with a non-conductive material to reduce any risk of electrical shock or short circuit.

It is therefore an object of this invention to provide a spark enhancing device for the ignition system of an internal combustion engine.

Still another object of this invention is to provide a simple addition to each of the spark plug wires which has shown measurable improvement upon the performance of an internal combustion engine.

Yet another object of this invention is to provide an improved spark plug wire which conveys higher ignition voltage from an ignition source to the spark plug of an internal combustion engine.

Still another object of this invention is to provide an improved ignition system spark voltage at the spark plug without substantial radio interference produced therefrom.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
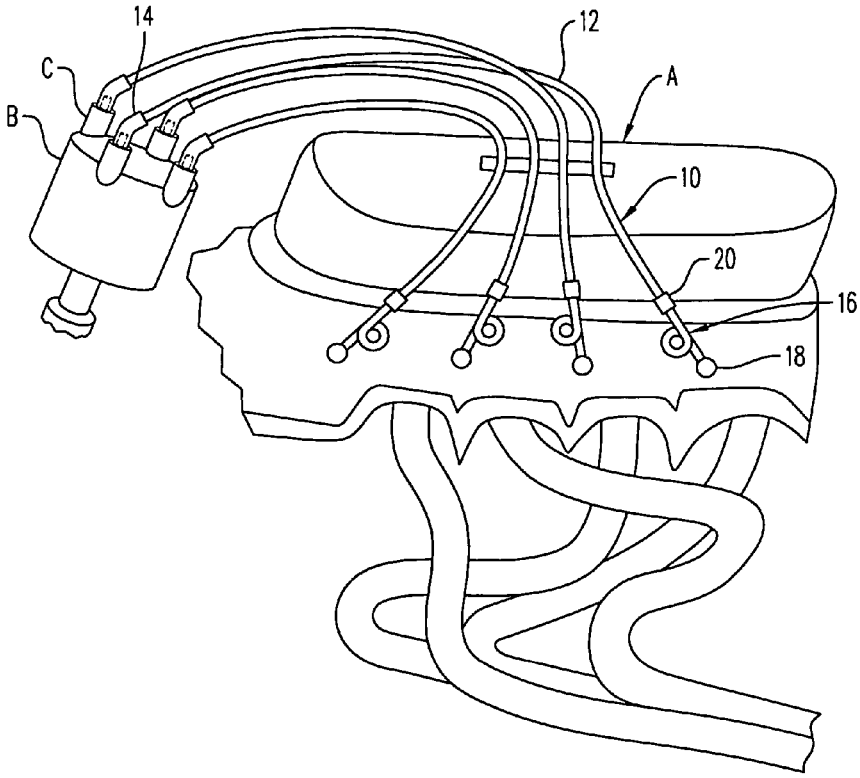
FIG. 1 is a perspective schematic view of the invention installed into each spark plug wire of an internal combustion engine.
Figure 2:
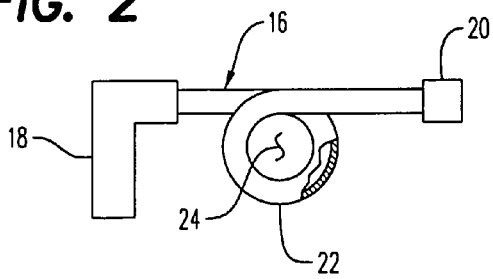
FIG. 2 is a side elevation view of the invention shown in FIG. 1.
Figure 3:
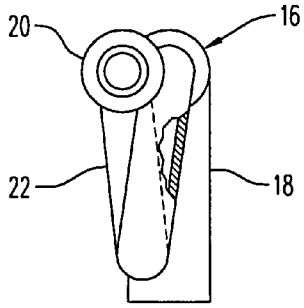
FIG. 3 is a right end elevation view of FIG. 2.

Referring now to the drawings, the invention, in one embodiment thereof, is shown generally at numeral 16 in FIGS. 1 to 3. In FIG. 1, the device 16 is shown interconnected in series along the length of each spark plug wire 12 which extends at connector 14 from an outlet port C of a spark source B to the spark plug cap 18 one of the spark plugs (not shown) of an internal combustion engine A.

The spark source B is typically in the form of a distributor having a spark coil for spark voltage buildup and a distributor plate which sequentially distributes spark voltage and current to each of the spark plug wires 12 for sequential firing of each of the spark plugs in a predetermined sequence.

This embodiment of the device 16 includes a coiled length of copper tubing having a single helix wound loop 22 formed centrally therealong. One end 20 of the device 16 is interconnected (or interconnectable) to one end of each spark plug wire 12 while the other end 18 of the device 16 is structured as a spark plug cap which tightly fits over the exposed end of the spark plug, making electrical contact with the metallic spark plug tip (not shown).

In this embodiment 16, the sizing of the copper tubing has been selected as having an outside diameter of ⅛" (O.D.) an inside diameter (I.D.) of 1/16" and a wall thickness of approximately 1/32". The tubing is wrapped around a shaft having a diameter of 24 of ¼" in helix fashion.

Figure 4:
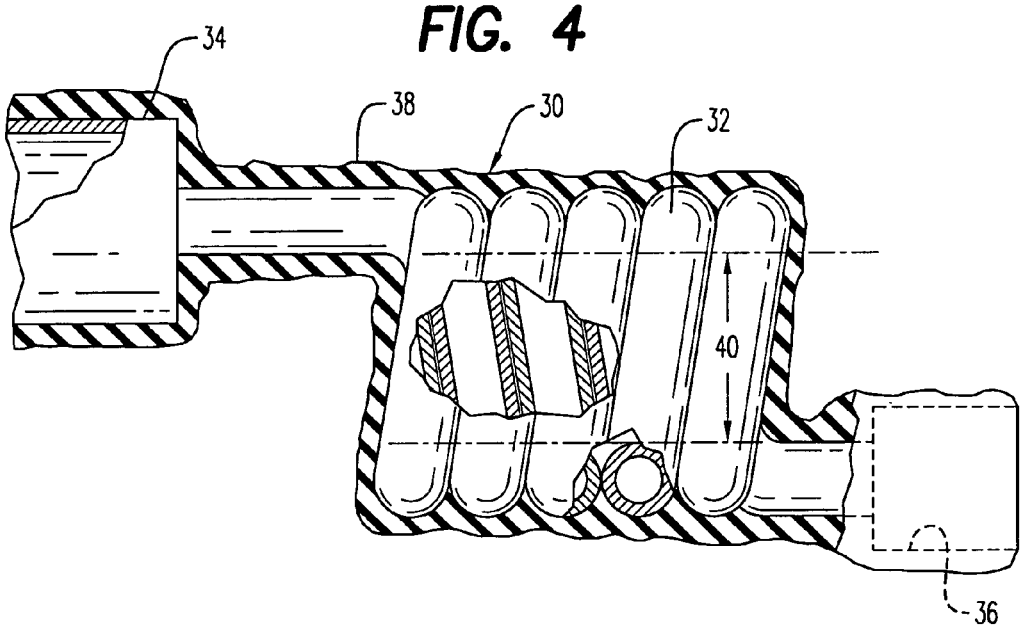
FIG. 4 is a side elevation view in partial section of a preferred embodiment of the invention.

Referring now to FIG. 4, the preferred embodiment of the invention is there shown at numeral 30. This embodiment 30 is also formed of a single length of copper tubing also having an outside diameter (O.D.) of ⅛", an inside diameter (I.D.) of 1/16" and a wall thickness of 1/32". This embodiment 30 includes five loops or turns 32 of the copper tubing, these loops 32 being formed about a mandrel or shaft having an outside diameter of ¼" as shown at numeral 40.

One end 36 of the device 30 is structured for interconnection to an end of the spark plug wire while the other end 34 is structured as a spark plug cap for interconnection onto the exposed end of a spark plug. However, it should be understood that these end configurations also may be permanently connected to, and along the length of, the spark plug wire at each end thereof, utilizing a conventional spark plug connector and insulator boot rather than being directly connected directly to the spark plug.

Figure 5:
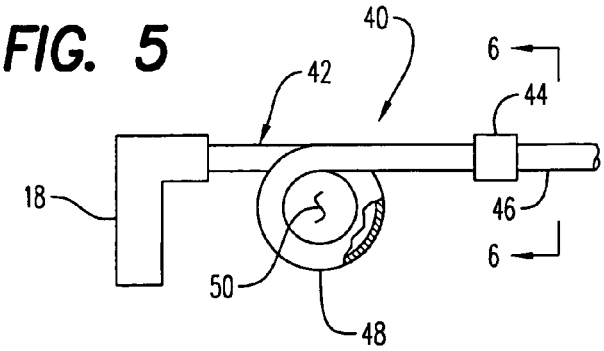
FIG. 5 is a side elevation view of another embodiment of the spark enhancing device of the invention shown in FIG. 1.
Figure 6:
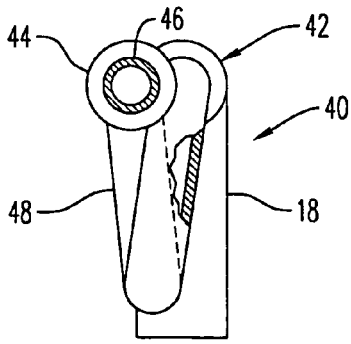
FIG. 6 is a section view in the direction of arrows 6—6 in FIG. 5.

Another embodiment of the invention is shown generally at numeral 40 in FIGS. 5 and 6 and includes a spark enhancing device 42 interconnected in series between the outlet port C of the spark source B to a spark plug cap 18 attached to one of the spark plugs of the internal combustion engine A as in FIG. 1.

This embodiment of the spark enhancing device 42 includes a coiled length of copper tubing having a single helix wound loop 48 formed centrally therealong. One end 44 of the device 42 is interconnected (or interconnectable) to one end of each new spark plug wire 46 while the other end 18 of the device 42 is structured as a spark plug cap which tightly fits over the exposed end of the spark plug, making electrical contact with the metallic spark plug tip (not shown).

In this embodiment 42, the sizing of the copper tubing has been selected as having an outside diameter of ⅛" (O.D.) an inside diameter (I.D.) of 1/16" and a wall thickness of approximately 1/32". The tubing is wrapped around a shaft having a diameter of 24 of ¼" in helix fashion. Because conventional carbon filled or impregnated spark plug wires have been found to be short lived when used in combination with the spark enhancing device 42, a new spark plug wire 46 preferably formed of the same copper tubing as that of the device 42 itself is provided. Apparently the heavier voltage and current imposed on the conventional spark plug wiring cause it to rapidly fail. Use of a continuous length of copper tubing to replace the conventional spark plug wire eliminates this problem and, in fact, appears to enhance overall performance and economy still further as briefly described in Example K.

Figure 7:
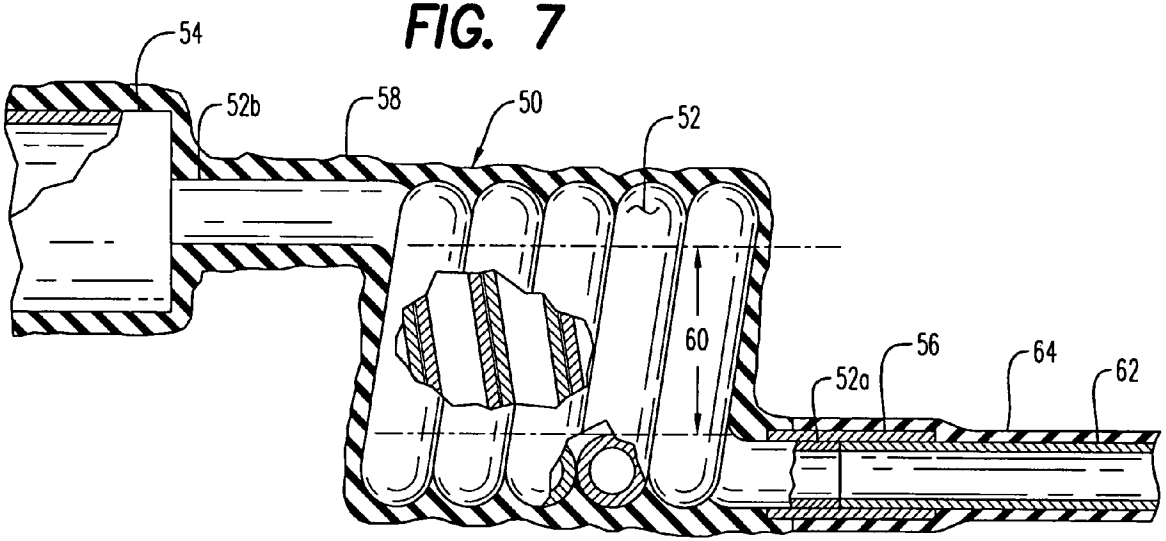
FIG. 7 is a side elevation view in partial section of still another embodiment of the spark enhancing device.

Referring now to FIG. 7, in another embodiment of the spark enhancing device of the invention is there shown at numeral 50. This embodiment 50 is also formed of a single length of copper tubing having an outside diameter (O.D.) of ⅛", an inside diameter (I.D.) of 1/16" and a wall thickness of 1/32". This embodiment 50 includes five loops or turns 52 of the copper tubing, these loops 52 being formed about a mandrel or shaft having an outside diameter of ¼" as shown at numeral 60 which may be increased to 5" in diameter or more for larger applications.

One end 52*b* of the device 50 is structured at 54 as a spark plug cap for direct interconnection onto the exposed end of a spark plug. The other end 52*a* of the device 50 is connected or made connectable by a metallic copper collar 56 to one end of a copper tube configured spark plug wire 62. The array of five turns of tubing 52, end 54 and collar 56 are encapsulated in a molded in place or hot dipped insulating layer 58 for electrical isolation with respect to other unrelated engine components.

This spark plug wire 62 is formed of the same tubing size and material as that of the multi-coils 52. A tubular insulating layer 64 extends along the entire length of the copper tubular spark plug wire 64 for electrical isolation thereof. As previously discussed, the overall durability of this form of spark plug wire 62 is greatly enhanced as the entire ignition system delivers substantially higher voltage to each spark plug and has been shown to be detrimental to a conventional carbon filled spark plug wire.

Figure 7A:
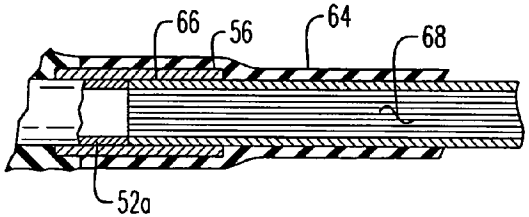
FIG. 7A is a side elevation view of an alternate embodiment of one end of FIG. 7.

Referring now to FIG. 7A, an alternate embodiment of the spark plug wire is there shown at 68 in the form of strands of solid copper wire bundled together within a non-conductive jacket 66. This spark plug wire 68 abuts against one end 52*a* of the device 50, the two being joined in end-to-end fashion as shown by a conductive collar 56 and an insulating tubular casing or sheath member 64 which is shrink wrapped tightly therearound.

Figure 8:
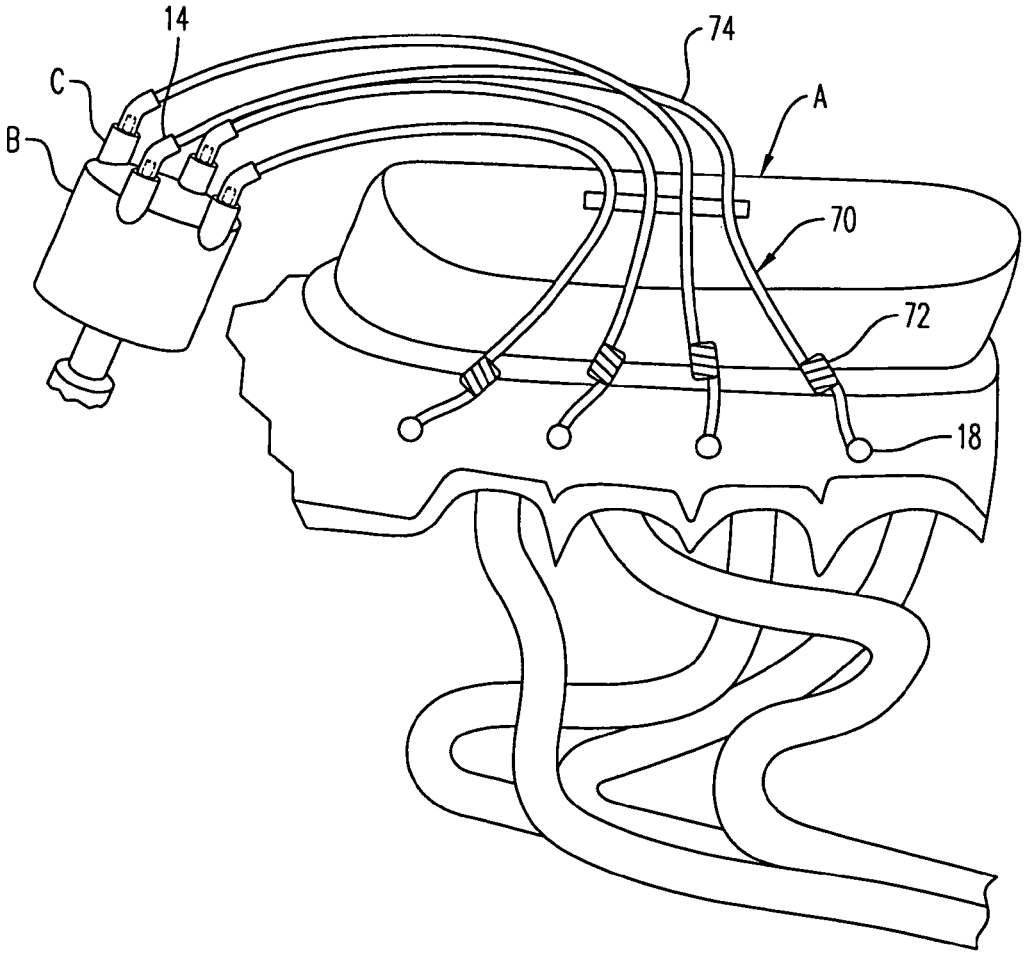
FIG. 8 is a perspective schematic view of yet another embodiment of the invention which totally replaces each spark plug wire of an internal combustion engine.
Figure 9:
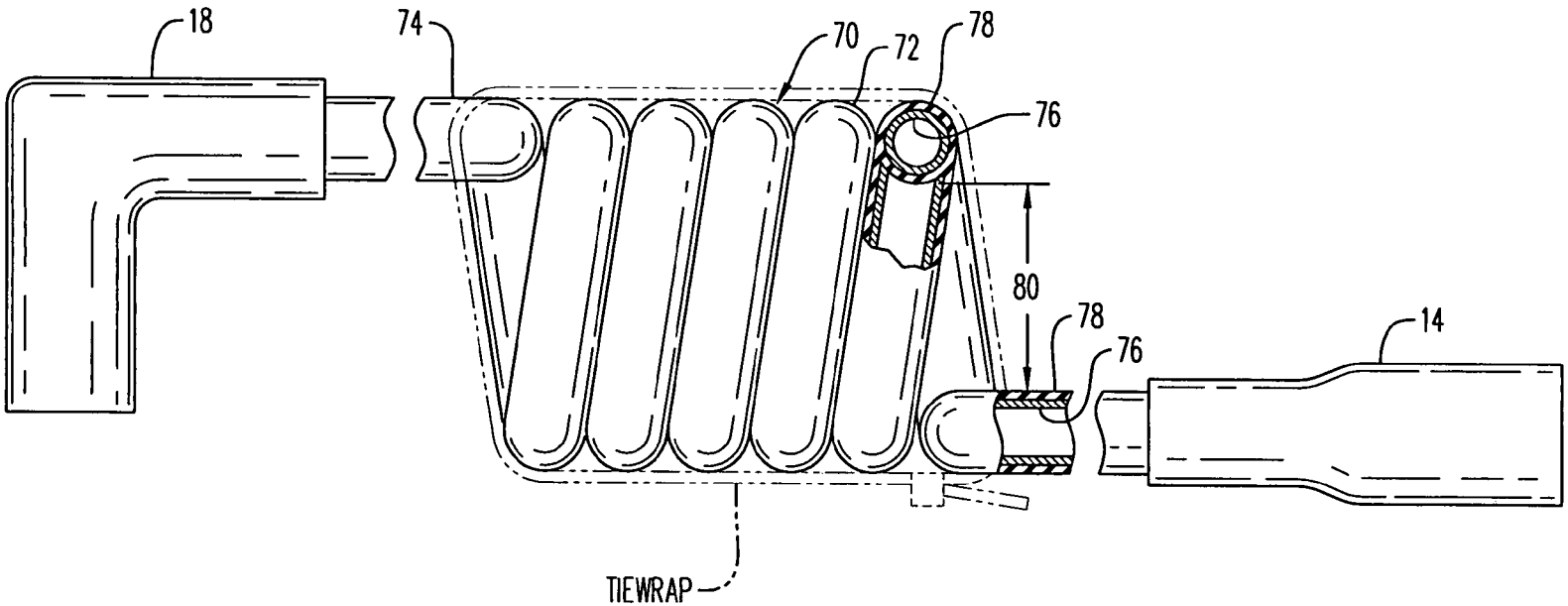
FIG. 9 is a side elevation view in partial section of the embodiment shown in FIG. 8.

Referring now to FIGS. 8 and 9, still another embodiment of the invention is there shown generally at numeral 70 and is formed of a single length of copper tubing 76 having an outside diameter (o.d.) of ⅛", an inside diameter (i.d.) of 1/16", a wall thickness of 1/32" and encapsulated in its entirety by an insulating layer 78 for electrical isolation thereof with respect to other unrelated engine components or engine compartment equipment. This embodiment 70 is more economical to manufacture in that the single length of copper tubing with insulating layer formed thereon is then formed to include a spark plug cap 18 at one end thereof and a distributor connector 14 formed at the other end thereof. The spark plug cap 18 connects onto a conventional spark plug (not shown) while the connector 14 is connected into an outlet port C of a distributor or spark source B.

Formed along the length of the insulated copper tubing length 74 are a series of tightly wrapped coils or loops 72 which are wrapped around a mandrel having an outside diameter of ½" to form an inner cylindrical surface 80 formed of the loops 72. Note that a tie wrap may be used and is preferred so as to retain the tight uniform coiling in the position shown in FIG. 9.

Performance Results

Several informal tests were conducted to verify the observed validity of the performance enhancing aspects of the invention. These are shown in the example herebelow.

EXAMPLE A

A 2001 Suzuki RM 250 dirt bike was initially tested utilizing the factory ignition system. The top speed was measured at 60 to 65 mph achieved from a standing stop over a distance of 660 feet in approximately 10 seconds. The test rider and owner of the dirt bike provided a subjective evaluation of the bike as having a great deal of vibration which was very tiring so that he was unable to ride the bike for long periods of time. The test driver/owner also observed that the "power band" is present only for about the first ten feet in each of the gears of the manual transmission shift pattern.

Test #1:

A device formed in accordance with the present invention as described in FIG. 4 except for the coil 32 being formed of solid copper wire and using the existing spark plug wire was installed into the spark plug wires of the Suzuki engine. Although the "power band" seemed to last for up to thirty feet at the beginning of each gear shift, the dirt bike achieved a speed of 63 miles an hour, but accomplished this in excess of 10 seconds. It was determined from this test that a coiled solid copper wire device did not provide sufficient enhancing performance to satisfy applicant.

Test #2:

A hollow copper tubing device formed in accordance with FIG. 4 and the description therewith was then installed into the existing spark plug wires of the device and tested. The "power band" stayed in or lasted for approximately thirty feet and the dirt bike achieved a top speed of 73 mph or an increase of approximately 15 to 20%. The time to achieve that top speed was reduced to 9.0 seconds. The rider/owner observed that the vibration from the engine had been substantially reduced and that takeoff power and torque was substantially increased.

Test #3:

Without the rider/owner's knowledge, a "dummy" device was installed. The maximum speed achieved was 66 mph over a time of 10.25 seconds. The rider/owner observed far less power and more vibration and, when he realized by the lack of performance that the device had been removed, complained for it to be reinstalled.

EXAMPLE B

A 1986 Honda "Big Red" three-wheeler having a 250 cc engine was also tested.

Test #4:

With the standard ignition system, this three-wheeler achieved a top speed of 42 mph. Over a marked distance of 270' on a blacktop road, the factory ignition setup achieved 29 mph in 10.25 seconds. The rider observed a great deal of vibration.

Test #5:

A solid copper device formed of solid wire in accordance with the general description as in FIG. 4 was then tested. Due to excessive vibration, top speed could not be determined. However, over the marked distance of 270', the three-wheeler achieved a top speed of 29 mph in 10.25 seconds, exactly the same as the factory ignition system achieved.

Test #6:

Utilizing a device formed of hollow copper wire as described in FIG. 4 except using the existing spark plug wire, a top speed of 52 mph was achieved. Over the distance of 270', the three-wheeler achieved a top speed of 34 mph in 8.2 seconds, an increase in speed of approximately 17% and a decrease in time to achieve that speed of approximately 20%. The maximum or top speed achieved was 52 mph for a substantial increase of approximately 24%. The rider also observed a substantial decrease in engine vibration and found the three-wheeler much easier to handle as a result thereof.

EXAMPLE C

A 1980 Z-28 Camaro having a 350 cu. in. engine was also tested.

Test #7:

Without the device and utilizing factory ignition, the vehicle achieved a speed of 60 mph from a standstill in approximately 8 seconds.

Test #8:

Utilizing the device formed of hollow copper wire as described in FIG. 4 installed onto each of the existing spark plug wires, the vehicle achieved a 0 to 60 speed in approximately 7½ seconds, a decrease in time to achieve that speed of 60 mph of approximately 6%.

The economy of this vehicle was also evaluated on a cursory basis. After the vehicle had been driven and tested with the device 30 installed into each of the existing spark plug wires and then removed, economy began to noticeably decrease after approximately 100 miles from the original economy of 20.5 mpg down to approximately 17.5 mpg. The device 30 was then reinstalled into each of the spark plug wires, the 0 to 60 speed performance was regained, and the mileage increased back up to approximately 20.5 mpg for an increase of approximately 17%.

EXAMPLE D

A '96 Vermeer stump grinding machine having a 60 hp air-cooled engine used commercially by applicant was also evaluated.

Test #9:

To cut a pine stump 2" above the ground and 24" in diameter cut down to 6" below grade level would normally take approximately 10 minutes.

Test #10:

Utilizing the device 30 as shown in FIG. 4 installed into the existing spark plug wires for each spark plug of the stump machine, the time to perform the same stump-grinding operation was reduced to five minutes. Applicant also observed that the engine ran smoother and could take deeper bites for each pass without excessive engine lugging. A further obvious benefit utilizing this device based upon the time reduction for performing the stump-grinding operation was that the fuel consumption was reduced by approximately 50% as well.

EXAMPLE E

A 1989 Ford 150 pickup truck having a six cylinder engine was also tested for economy only.

Test #11:

Utilizing the factory ignition system, the pickup truck typically achieved 12 mpg in city traffic.

Test #12:

Utilizing the device 30 as shown in FIG. 4 installed into each existing spark plug wire, the economy increased to approximately 17.6 mpg, about a 45% mileage increase.

EXAMPLE F

A 1993 Honda Passport having a 70 cc engine was also evaluated.

Test #13:

Utilizing the factory ignition, the top speed achieved by this vehicle was 40 mph.

Test #14:

Utilizing the device shown in FIG. 4 and the existing spark plug wires, the vehicle top speed increased to 45 mph, an improvement of approximately 12½%.

EXAMPLE G

A HUSKY 6.4 mulcher was also tested. This mulcher has a double cutting feature wherein one side is utilized for small limbs and branches while the other side is used for leaves and twigs.

Test #15:

Utilizing the conventional ignition system for this mulcher, only branches and limbs up to 1½" to 2" in diameter could be handled on the first side of the mulcher.

Test #16:

After installing the invention in the form shown in FIG. 4 at numeral 30 into the existing spark plug wiring, the mulcher was able to chip limbs up to 3" in diameter. The owner of this mulcher indicated that the mulcher was never able to chop limbs that large in the past.

EXAMPLE H

A 2001 TORO Powerhouse Dingo having a 20 hp engine was also tested.

Test #17:

Utilizing the stump grinder attachment for the Dingo, with the conventional ignition system, a 15" stump normally requires approximately 15 minutes to cut. The Dingo also achieves a top speed of 3 mph.

Test #18:

Utilizing the present invention installed along the conventional spark plug wire, the top speed of the Dingo increased to 5 mph and, with the stump grinder attachment, a 15" stump was cut in approximately 10 minutes, a 33% reduction in time for cutting and a 67% increase in top speed.

EXAMPLE I

A 1986 Toyota Tacoma having a four cylinder engine utilized as a mail delivery vehicle was also tested for economy.

Test #19:

Using the conventional factory ignition system, the Tacoma will typically run approximately 2½ days on a single tank of gas.

Test #20:

With the present invention in the form shown in FIG. 4 installed along each of the existing spark plug wires, the Tacoma will now run 3½ days on a single tank of gas of the same quantity for an increase of approximately 40% in running time under the same conditions of mail delivery.

EXAMPLE J

An ECHO 3000 12" chain saw was also tested for performance.

Test #21:

Utilizing the factory ignition system, a cut traversely through a 12" diameter pine log took approximately 30 seconds.

Test #22:

With the device as shown in FIG. 4 at numeral 30 installed into the existing spark plug wire, the same cut through a 12" diameter pine log took only 25 seconds due to the fact this chainsaw performed having higher lugging power with much less vibration representing a service time decrease of approximately 17%.

EXAMPLE K

A 1992 Oldsmobile Delta 88 powered with a 3.800 C.I.D. V-6 engine was next tested for economy.

Test #23:

Utilizing the factory ignition system, this vehicle averaged 24 mpg at highway speeds averaging 65 mph.

Test #24:

Utilizing the device as shown in FIG. 4 at numeral 30 installed into the existing spark plug wiring, this vehicle increased in overall economy to approximately 26 mpg. However, after approximately 300 miles of driving, the existing factory-installed spark plug wires failed as evidenced by poor engine operation and signs of having been overheated and physically burned or charred.

Test #25:

The device as shown in FIG. 4 at numeral 30 was installed into the vehicle utilizing new spark plug wires 42 extending from the distributor to the device 30 and being formed of copper tubing as described with respect to FIG. 4. This vehicle so equipped increased in overall economy to approximately 30 mpg or about 25% in a driving schedule that included both highway speeds of 65 mph and some stop and go driving over a total mileage of 440 miles. No damage to any aspect of the ignition or engine was detected during this extended test.

ADDITIONAL EXAMPLES

Several additional examples of the successful testing of this invention are briefly described as follows using the embodiment of the invention shown in FIG. 9:

Test #26:

A 1993 Chevrolet pickup powered by a 4.3 liter V6 showed an increase in average mileage from 15 mpg to 20 mpg.

Test #27:

A 1996 Jeep Cherokee powered by a 4 cylinder engine showed an improvement in average economy of from 14.5 mpg to 19.5 mpg.

Test #28:

A 1997 Harley Davidson motorcycle powered by a 1200 cc engine showed an increase in the average fuel economy from 43 mpg to 48 mpg.

Test #29:

A 2002 Chevrolet Avalanche SUV powered by a 5.3 liter V-8 showed an increase in mileage of from an average of 16 mpg to an average of 28 mpg, a startling result.

Test #30:

A 1987 Chevrolet ¾ ton pickup powered by a 350 cu. in. V-8 engine increased in mileage from an average of 8 mpg to 12 mpg.

Test #31:

A 1989 Ford F150 conversion van powered by a V-8 engine showed an increase in fuel economy of from 8 mpg to 12 mpg.

Test #32:

A 2002 Kawasaki Nomad powered by a 1500 cc engine increased in mileage from 30 mpg to 34 mpg.

Test #33:

A 1986 Nissan 4 cyl. pickup showed an increase in mileage from 31 mpg to 34 mpg.

Test #34:

A 1999 Chevrolet Blazer 4×4 powered by a 4.3 liter V-6 increased in mileage from 16 mpg up to between 20 and 24 mpg.

Test #35:

Thunder Autosports, Inc. dynamometer tested a 2003 Chevrolet S-10 pickup, previously driven about 14,000 miles, powered by a 4.3 liter V-6 engine. These actual dynamometer test results showed an average increase in horsepower and torque of about 9% between 3300–3900 rpm.

Theory of Operation

Applicant can only speculate as to the theory of the enhanced performance achieved by internal combustion engines equipped with the present invention installed into each spark plug wire thereof. The preferred positioning of the device is approximately 2 to 4 inches from the spark plug along the length of the spark plug wire. However, as previously described, the positioning of the device may be anywhere along the length of the spark plug wire, including at the distal end thereof and forming the spark plug cap as well.

Utilizing a sensitive ohm meter, some insight into the theory of operation may be gained. Consistently, utilizing the hollow copper tubing to form the device, the resistance in ohms of the entire spark plug wire or simply a length of copper tubing in straight form versus being coiled into successive loops shows significant changes in measured resistance. That is to say that, when the device is installed into the length of a spark plug wire, the overall resistance between the source of the spark and the spark plug cap was reduced measurably from 13.1 ohms down to 1.9 ohms according to the meter utilized.

This significant decrease in resistance would appear to be at least one basis for explaining why the present invention produces more power, acceleration and economy from virtually all spark plug ignited internal combustion engines tested by applicant to evaluate the efficacy of this invention.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. An ignition sparkplug wire device connected or connectable in the electrical path between a spark source and a spark plug of an internal combustion engine comprising:

a length of conductive hollow tubing substantially coated with a non-conductive material and formed to include a plurality of substantially concentric loops arranged in closely spaced helix fashion and positioned between each end of said hollow tubing;

one said end connected to, or configured for connection to the spark source while the other said end is connected to, or configured for connection to, a spark plug.

2. An ignition sparkplug wire as set forth in claim 1, wherein:

said tubing has five (5) complete loops.

3. An ignition sparkplug wire as set forth in claim 2, wherein:

each said loop has an inside diameter (I.D.) of in the range of ⅛" to 5".

4. An ignition sparkplug wire disposed in the electrical path between a spark source and a spark plug of an internal combustion engine comprising:

a coil having at least one complete loop formed into a length of electrically shielded conductive tubing connectable to the spark source at one end thereof and to a sparkplug t another end of said tubing.

5. An ignition sparkplug wire as set forth in claim 4, wherein:

said coil has five (5) complete loops.

6. An ignition sparkplug wire as set forth in claim 4, wherein:

said coil has an inside diameter (I.D.) of at least about ⅙" and an outside diameter (O.D.) of up to about ½" and a wall thickness of about 1/32".

7. An ignition sparkplug wire as set forth in claim 4, wherein:

said device is substantially coated with a non-conductive material.

8. An ignition sparkplug wire connected or connectable in the electrical path between a spark source and a spark plug of an internal combustion engine comprising:

a length of conductive hollow tubing including a coil having a plurality of substantially concentric loops arranged in closely spaced helix fashion;

a first end of said tubing being connected to, or configured for connection to the spark plug while a second end of said tubing being connected to, or configured for connection to, the spark source.

* * * * *